US006820384B1

(12) United States Patent
Pfeiffer

(10) Patent No.: US 6,820,384 B1
(45) Date of Patent: Nov. 23, 2004

(54) PREFABRICATED FOAM BLOCK CONCRETE FORMS AND TIES MOLDED THEREIN

(75) Inventor: Henry Edward Pfeiffer, Omaha, NE (US)

(73) Assignee: Reward Wall Systems, Inc., Omaha, NE (US)

( * ) Notice: Subject to any disclaimer, the term of this patent is extended or adjusted under 35 U.S.C. 154(b) by 0 days.

(21) Appl. No.: 09/691,934

(22) Filed: Oct. 19, 2000

(51) Int. Cl.[7] ..... E04B 2/86

(52) U.S. Cl. ..... 52/426; 52/309.15; 52/309.17; 52/442; 52/591.2

(58) Field of Search ..... 52/591.1, 591.2, 52/426, 442, 565, 309.15, 309.17

(56) References Cited

U.S. PATENT DOCUMENTS

| | | | |
|---|---|---|---|
| 3,788,020 | A | 1/1974 | Gregori |
| 3,895,469 | A | 7/1975 | Kapitan |
| 4,223,501 | A | 9/1980 | DeLozier |
| 4,229,920 | A | 10/1980 | Lount |
| 4,439,967 | A | 4/1984 | Dielenberg |
| 4,516,372 | A | 5/1985 | Grutsch |
| 4,604,843 | A | 8/1986 | Ott et al. |
| 4,706,429 | A | 11/1987 | Young |
| 4,730,422 | A | 3/1988 | Young |
| 4,742,659 | A | 5/1988 | Meilleur |
| 4,788,020 | A | 11/1988 | Yampolsky et al. |
| 4,852,317 | A | 8/1989 | Schiavello et al. |
| 4,860,515 | A | 8/1989 | Browning, Jr. |
| 4,866,891 | A | 9/1989 | Young |
| 4,879,855 | A | 11/1989 | Berrenberg |
| 4,884,382 | A | 12/1989 | Horobin |
| 4,885,888 | A | 12/1989 | Young |
| 4,889,310 | A | 12/1989 | Boeshart |
| 4,894,969 | A | 1/1990 | Horobin |
| 4,901,494 | A | 2/1990 | Miller et al. |

(List continued on next page.)

*Primary Examiner*—Michael Safavi
(74) *Attorney, Agent, or Firm*—Blackwell Sanders Peper Martin LLP

(57) ABSTRACT

A foam block concrete form having a pair of opposing foam panels spaced parallel from each other, and retained in opposing fashion by a plurality of transverse ties therebetween. Each panel has opposing longitudinal edges having engaging means formed therealong for removably retaining a longitudinal edge having similar engaging means formed therealong when adjacent thereto. The plurality of substantially planar include a web portion separating a pair of opposing flange members encapsulated within respective opposing foam panels along a respective lateral axis.

17 Claims, 8 Drawing Sheets

U.S. PATENT DOCUMENTS 4,916,879 A 4/1990 Boeshart
4,936,540 A 6/1990 Boeshart
4,967,528 A 11/1990 Doran
5,014,480 A 5/1991 Guarriello et al.
5,024,035 A 6/1991 Hanson et al.
5,060,446 A 10/1991 Beliveau
5,065,561 A 11/1991 Mason
5,122,015 A 6/1992 Shen
5,123,222 A 6/1992 Guarriello et al.
5,163,261 A 11/1992 O'Neill
5,351,455 A 10/1994 Schoonover et al.
5,390,459 A * 2/1995 Mensen ..... 52/426
5,428,933 A 7/1995 Philippe
5,454,199 A 10/1995 Blom et al.
5,459,971 A 10/1995 Sparkman
5,465,542 A 11/1995 Terry
5,491,949 A 2/1996 De Moor
5,566,518 A 10/1996 Martin et al.
5,568,710 A 10/1996 Smith et al.
5,570,552 A 11/1996 Nehring
5,596,855 A 1/1997 Batch
5,611,183 A 3/1997 Kim
5,617,693 A 4/1997 Hefner
5,625,989 A 5/1997 Brubaker et al.
5,657,600 A 8/1997 Mensen
5,701,710 A 12/1997 Tremelling
5,704,180 A 1/1998 Boeck
5,709,060 A 1/1998 Vaughan et al.
5,735,093 A 4/1998 Grutsch
5,803,669 A 9/1998 Bullard
5,809,727 A 9/1998 Mensen
5,809,728 A 9/1998 Tremelling
5,839,243 A 11/1998 Martin
5,845,449 A 12/1998 Vaughan et al.
5,852,907 A 12/1998 Tobin et al.
5,890,337 A 4/1999 Boeshart
5,896,714 A 4/1999 Cymbala et al.
5,930,958 A 8/1999 Stanley
6,070,380 A 6/2000 Meilleur
6,230,462 B1 * 5/2001 Beliveau ..... 52/426

* cited by examiner

PREFABRICATED FOAM BLOCK CONCRETE FORMS AND TIES MOLDED THEREIN

THE FIELD OF THE INVENTION

The present invention relates to Insulating Concrete Form Systems utilizing foam block forms and, more specifically, to improvements to the foam panels, the foam corner panels, the panel spacing ties, the corner spacing ties and the interaction of the ties with the foam panels.

BACKGROUND OF THE INVENTION

Insulating Concrete Form Systems (ICFS) are known which serve to contain fluid concrete while it solidifies as well as provide insulation for the finished structure. Such systems utilize a plurality of individual units, panels or blocks aligned horizontally and vertically in an interlocking arrangement to create forms for concrete walls. Each block comprises a pair of foamed plastic panels which are retained in a spaced relationship parallel to each other by a plurality of ties.

The spacing ties are truss-like and include opposing flange portions which reside within respective opposing foam panels. The opposing flange portions are separated by an intermediate web portion connected therebetween, enabling the tie to hold and secure the panel portions. Some prior designs teach slide-in ties having flanges which are configured to be complementary with slots formed in the panels. Such block designs have the disadvantage of requiring work-site assembly.

Other prior art ICFS designs teach the use of prefabricated foam block concrete forms in which opposing flanges of each tie are molded into respective opposing foam walls of the foam block. While each of these ICFS designs teaches the use of a foam form block having a lower longitudinal edge designed to engageably receive only the upper longitudinal edge of a similar block therebelow, and an upper longitudinal edge designed to engageably receive only the lower longitudinal edge of a similar block thereupon, none teach the use of a prefabricated, continuous-concrete-wall-generating, foam form block having opposing horizontal longitudinal edges designed to engageably receive either opposing horizontal longitudinal edge of an adjacent block having a substantially similar longitudinal edge design.

It is also known in the art to design ties for a foam form block that will produce two independently structurally sound half-height blocks if cut laterally in half. However, the top half of the block becomes unusable waste, in the event that it is necessary to remove the top half of the block along the horizontal midpoint, due to the fact that these ties are not used with foam blocks that are designed to be vertically reversibly interlocking with adjacent blocks. Furthermore, these prior art tie designs fail to optimize distribution of the flow of fluid concrete across the web portion of the tie. Rather, they serve to impede even distribution of the fluid concrete between the foam panels. Finally, none of the blocks used with these prior art tie designs are premarked along their horizontal midpoint to serve as a visual guide for accurately cutting the blocks in half laterally.

The prior art teaches the use of corner ties molded within foam blocks configured to function as corner molds for concrete poured therebetween. Such corner ties are intended to serve as anchors for exterior surfaces fastened to the exterior surface of the foam-and-concrete wall. However, the forces transmitted from the exterior wall covering to the corner ties to which it is anchored can cause the corner ties to be ripped from the foam block within which it is seated, unless the corner tie has a concrete-engaging member. Of the prior art corner ties that include a concrete-engaging member, some require on-site assembly of the concrete-engaging member, while others provide a corner tie having flange dimensions that yield flanges that are incapable of functioning as anchors to an exterior facade. None teach the design of a corner tie having a concrete-engaging member that requires no on-site assembly, and having flanges configured to function as anchors for an exterior facade.

Nowhere in the prior art is it taught to design a pre-built, solid-wall-generating, foam form corner block that is vertically reversible along its longitudinal axis, that is to say, a corner block having opposing horizontal longitudinal edges that can stackably engageably receive either opposing longitudinal edge of an adjacent block having similarly designed longitudinal edges. Such a block could function as a left corner or a right corner, and could be cut in half laterally yielding two usable corner halves. Such a design would yield increased versatility of the block and, consequently, produce less waste.

SUMMARY OF THE INVENTION

The apparatus of the present invention overcomes the weaknesses and disadvantages associated with prior art designs and teaches a more versatile tie and block design. The block of the present invention is a preconstructed unit including a plurality of tie members spaced apart from, and parallel to, one another.

The block of the present invention can be constructed in any of a variety of configurations including, but not limited to, a substantially planar or straight block and a 90° corner block. The block is designed to yield a solid, continuous concrete wall construction when connected horizontally and vertically to blocks of similar construction.

Either block configuration includes an opposing pair of foam panels. Identical arrays of alternating teeth and sockets are formed along opposing horizontal longitudinal edges of each panel to enable it to removably engage either opposing horizontal longitudinal edge of a vertically adjacent block panel having a substantially identical array of teeth and sockets formed along either longitudinal edge. Similarly, identical arrays of alternating teeth and sockets are formed along opposing vertical end edges of each panel to enable it to removably engage either opposing vertical end of a horizontally adjacent block panel having a substantially identical array of teeth and sockets formed along either vertical end edge.

As a result, a planar block of the present invention can vertically and horizontally engageably receive adjacent whole or half planar or corner blocks of the present invention, regardless of vertical orientation with regard to its horizontal longitudinal axis and regardless of horizontal orientation with regard to its vertical axis. Likewise, a corner block of the present invention can vertically and horizontally engageably receive adjacent whole or half planar or corner blocks of the present invention, regardless of vertical orientation with regard to its horizontal longitudinal axis and regardless of horizontal orientation with regard to its vertical axis. The corner block of the present invention can, therefore, function as a left corner block or a right corner block, as well as provide two functional half corner block units when the corner block is divided along its horizontal midpoint. To facilitate separating a block of either planar or corner configuration along its horizontal midpoint, the outer surface of either opposing panel of each block is pre-marked along its horizontal midpoint.

The horizontal dimension of a tooth along the longitudinal axis of the panel will determine the minimum increment to which a block can be vertically separated and yield a functioning block segment. Therefore, versatility of a foam form block to be separated into vertical segments is inversely proportional to the horizontal longitudinal tooth dimension. Conversely, the greater the cross-sectional area of the teeth, the stronger the teeth and the greater the cross-sectional area of the cavities. The greater the cross-sectional area of the cavities, the easier it is to remove contaminants therefrom to allow the block to be fully seated upon or below an adjacent block. Consequently, the optimum tooth dimension must balance the need for versatility in trimming the block into vertical segments with the need for tooth strength and easy removal of cavity contaminants.

Each tie has a web portion connecting opposing truss and flange members molded within opposing foam panels. The web is designed to provide centralized structural support not only within a whole block, but also within the half blocks created by dividing a whole block along its horizontal midpoint. At the same time, the tie web is designed to optimize the flow of liquid concrete poured between the opposing foam panels.

The web has a plurality of rebar-retaining seats formed thereon so that a rebar rod can be gravitationally placed within a given seat regardless of vertical orientation of the associated whole or half, planar or corner, block with respect to its horizontal longitudinal axis. The rebar-retaining seats of each tie are of sufficient dimension to allow unstraight rebar to be retained therein without imparting undesirable torque forces to the tie member. Furthermore, the seat dimensions allow for overlapping ends of longitudinally adjacent rebar members to be retained therein to create, in effect, a wireless contact splice when the ends are imbedded in hardened concrete.

The corner block of the present invention includes a corner tie having a pair of corner flanges connected to a structural web member, all of which are encapsulated within a foam outer corner panel member to which the exterior siding will be attached. A concrete-engaging member extends inwardly from the structural web of the corner tie beyond the inner surface of the outer corner panel to serve as an anchor, when surrounded by concrete poured between opposing corner panels, to prevent the corner tie from being ripped from the corner foam block unit when exterior siding is anchored thereto.

These and other objects and advantages of the present invention will become more apparent to those skilled in the art after consideration of the following specification taken in conjunction with the accompanying drawings wherein similar characters of reference refer to similar structures in each of the separate views.

DETAILED DESCRIPTION OF THE PREFERRED EMBODIMENTS

Figure 1:
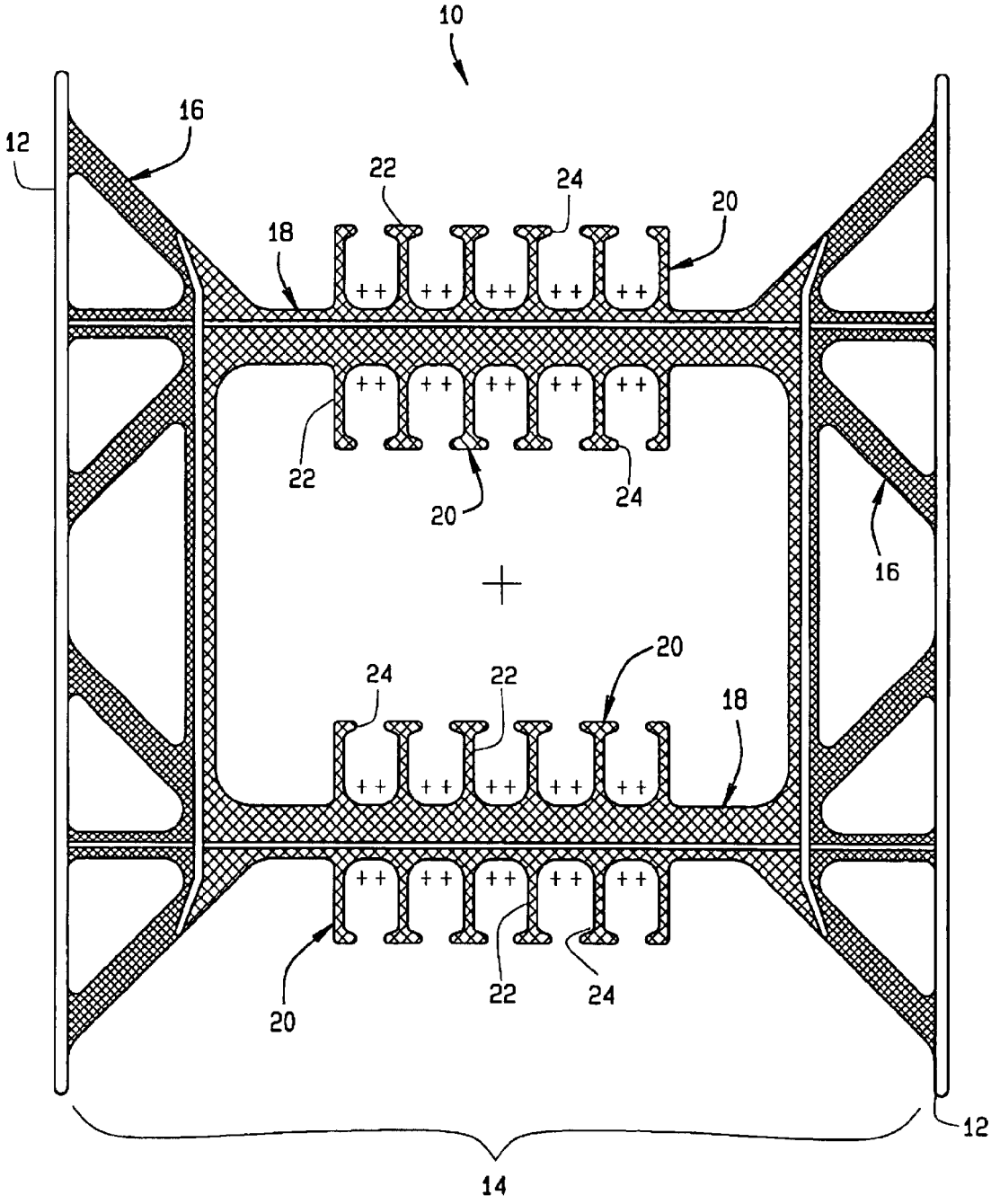
FIG. 1. is an elevational view of one embodiment of a tie of the present invention.

One embodiment of a tie 10 of the present invention is shown in FIG. 1. The tie 10 comprises a pair of flange members 12 separated by, and connected to, a web portion 14. The web portion 14 includes a pair of opposing truss members 16 connected by a pair of substantially identical transverse bridge members 18 having a plurality of rebar-retaining seats 20 molded therein. In a preferred embodiment, the tie 10 is constructed from polypropylene. In other embodiments, the tie is constructed of metal, or other suitable materials.

The rebar seats 20 are substantially identical to each other in configuration, and are arranged in a pair of opposing rows along each transverse bridge 18. Each seat 20 consists of a substantially U-shaped well formed by a pair of adjacent fingers 22. An inwardly spanning lateral knuckle 24 is formed in either distal end of adjacent fingers 22, creating a distance between opposing knuckles 24 that is substantially less than the lateral distance between the proximal ends of adjacent fingers 22.

The length of the fingers 22 is chosen in conjunction with the lateral distance between proximal ends of adjacent fingers 22 to create a substantially U-shaped well that is capable of retaining a pair of rebar rods diagonally therein. Alternatively, the seats 20 are of such dimension that a single unstraight length of rebar may be retained therein without imparting undesirable torque to portions of the web 14. The knuckles 24 associated with the given seat 20 serve to help retain the rebar therein.

Figure 2:
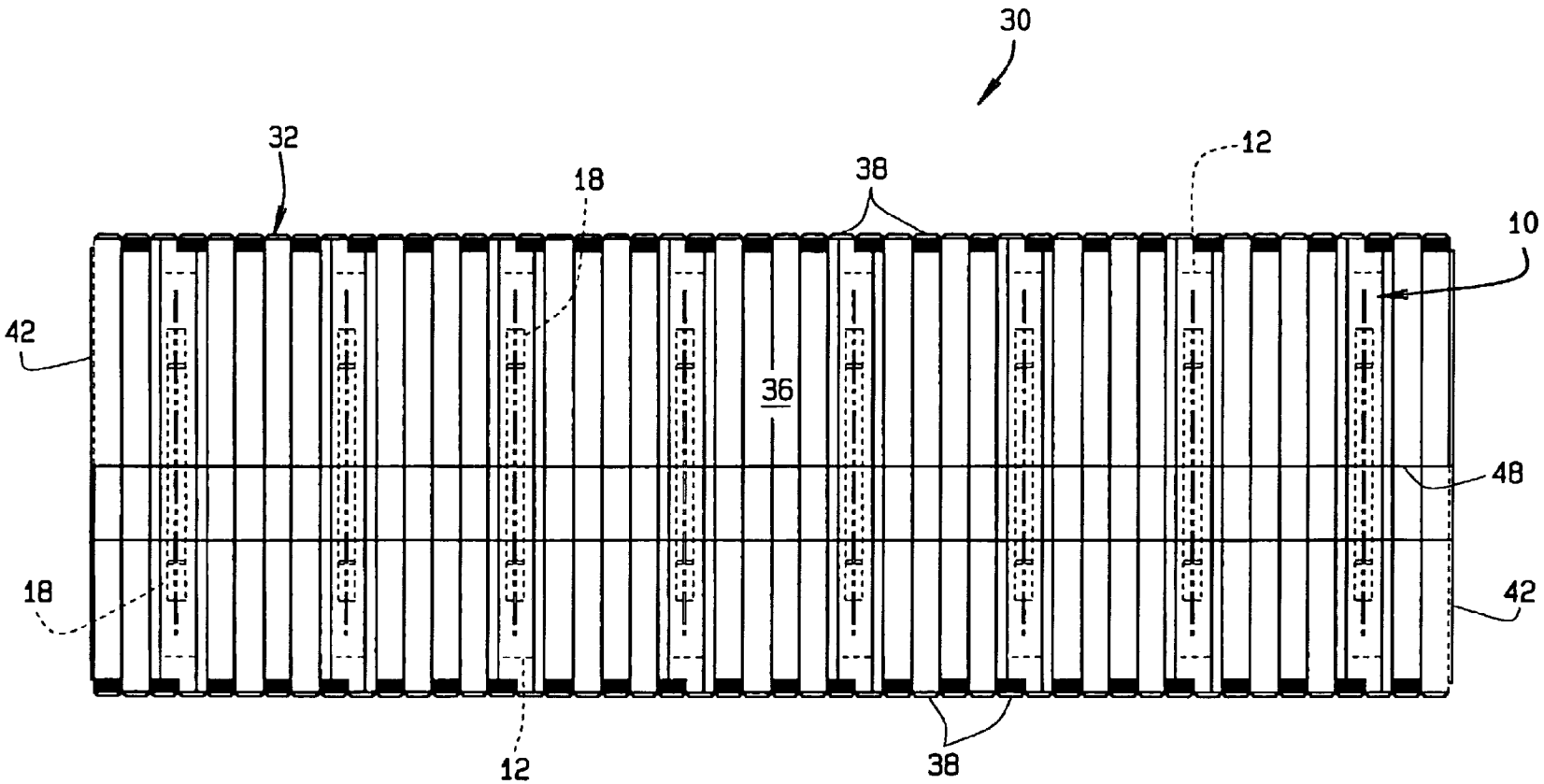
FIG. 2. is a front elevational view of a preconstructed straight foam form block of the present invention.
Figure 3:
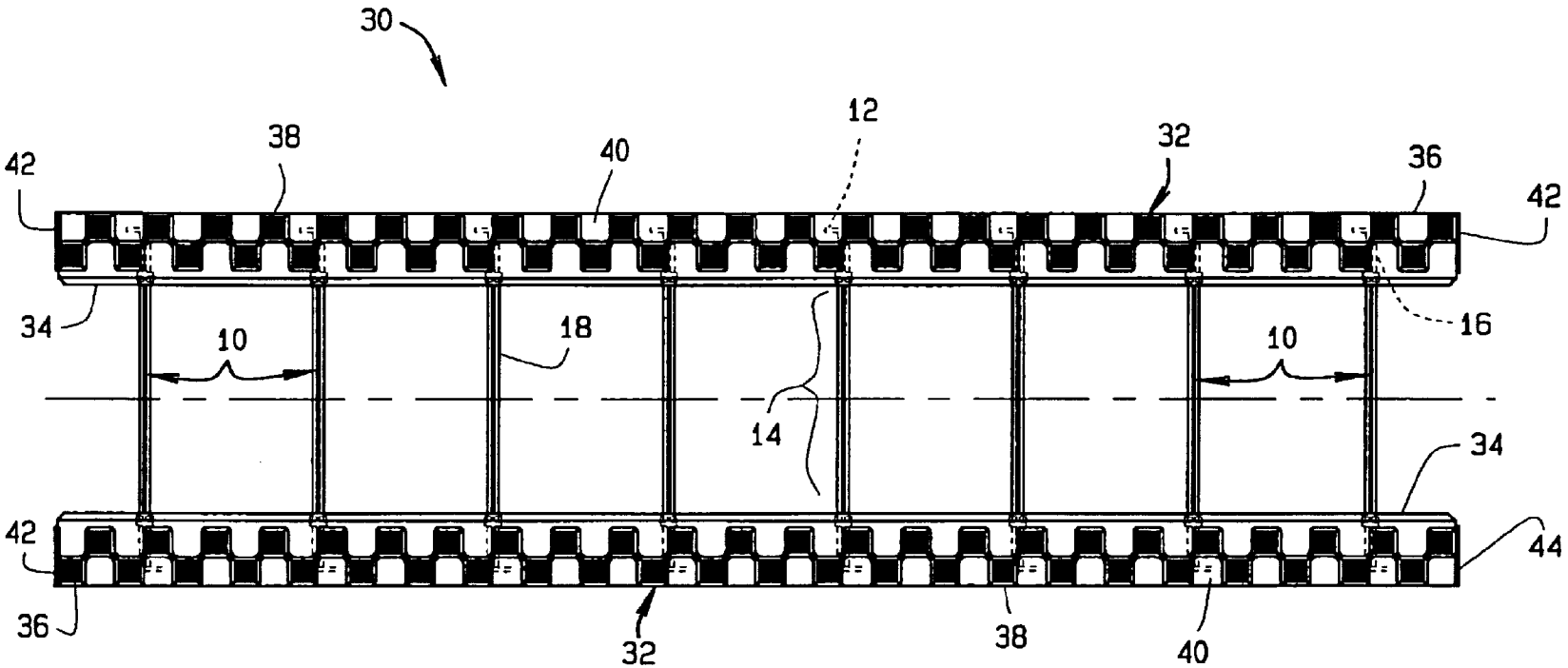
FIG. 3. is a plan view of the block shown in FIG. 2.
Figure 4:
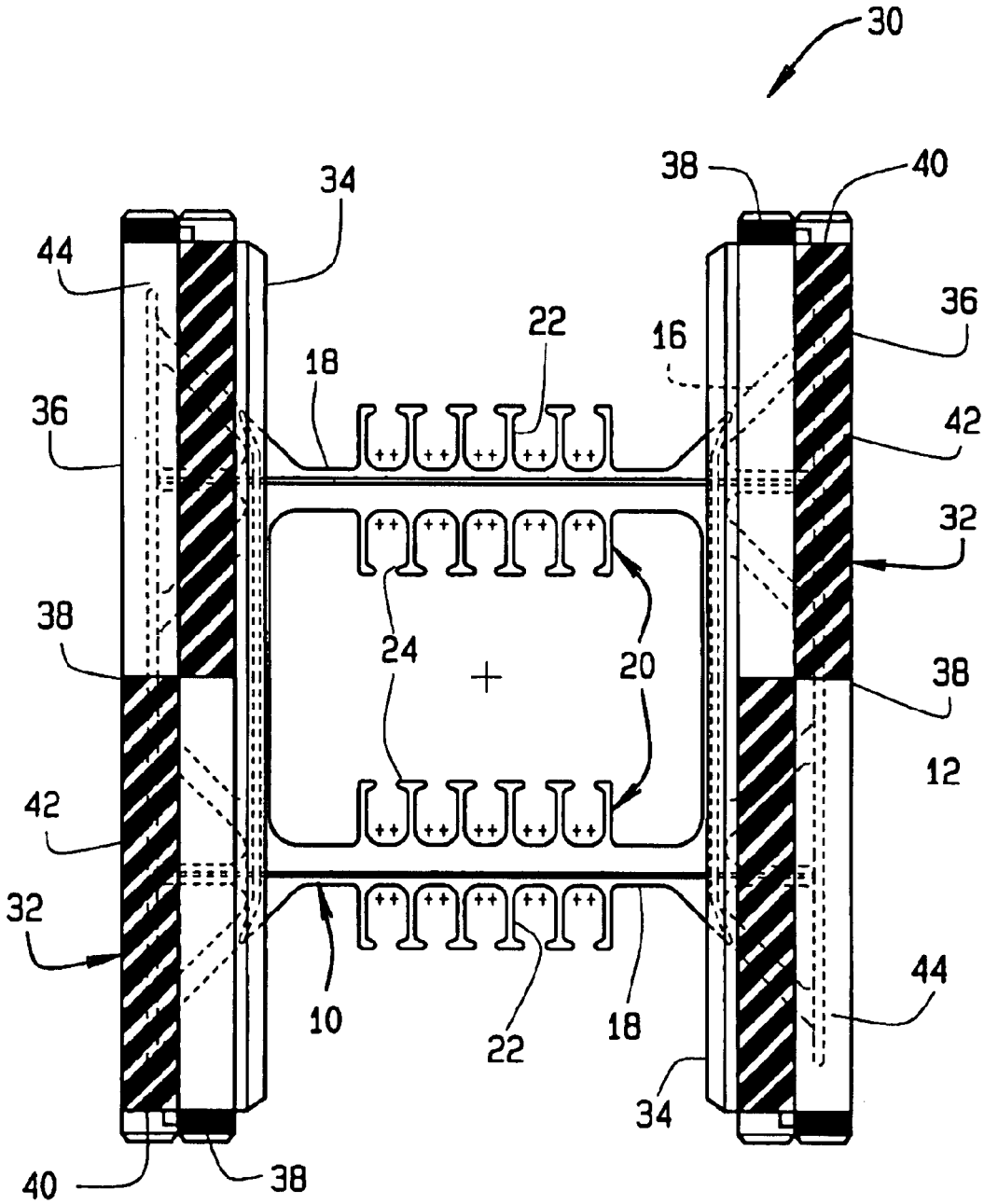
FIG. 4. is an end elevational view of the block shown in FIG. 2.

A substantially straight or planar foam form block 30 having at least one substantially planer rectangular segment is shown in FIG. 2 having a pair of parallel opposing foam panels 32 retained in spaced relationship to each other by a plurality of ties 10. As can be seen from FIGS. 3 and 4, the plurality of ties extends transversely between opposing inner surfaces 34 of the opposing panels 32. As can further be seen from FIGS. 3 and 4, the opposing flanges 12 and trusses 16 of each tie 10 are substantially retainably encapsulated within respective opposing foam panels 32 such that each flange 12 is seated inwardly from the outer surface 36 of the panel 32 within which it is encapsulated.

Figure 5:
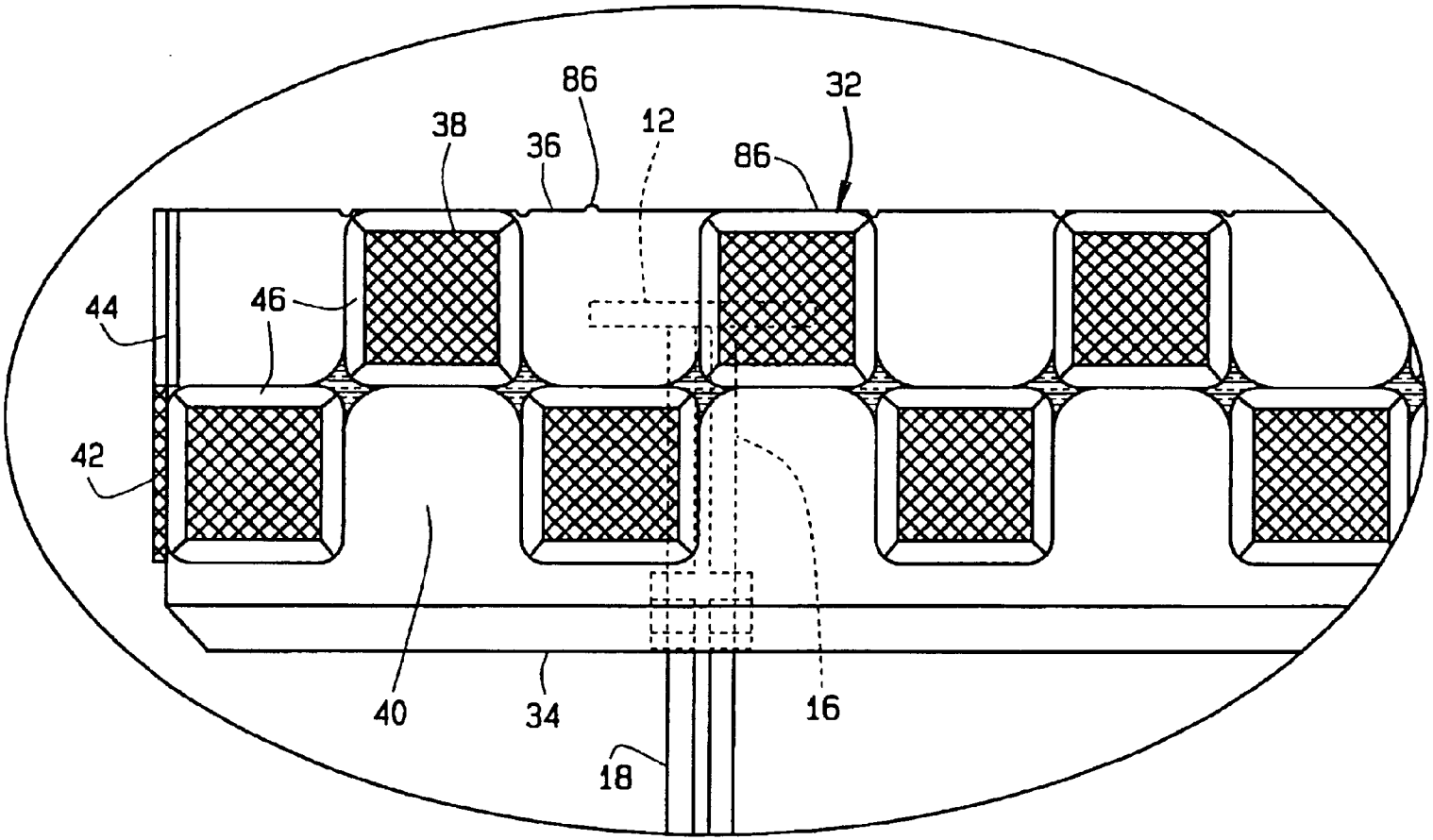
FIG. 5. is an enlarged plan view of a segment of the block shown in FIG. 2.

An array of alternating, equi-dimensional square teeth 38 and square sockets 40 are formed in opposing horizontal longitudinal edges of the panels 32, 72 and 78, as is best shown in FIG. 5. In a preferred embodiment, the array consists of two longitudinal rows of alternating teeth 38 and sockets 40, the rows being offset from each other by the distance of one side of one tooth 38. In addition, as best seen in FIG. 2, the teeth 38 associated with one of the opposed horizontal longitudinal edges of the panels 32, 72 and 78 are vertically aligned with the sockets 40 associated with the other of the opposed horizontal longitudinal edges of the panels 32, 72 and 78; and the sockets 40 associated with one of the opposed horizontal longitudinal edges of the panels 32, 72 and 78 are vertically aligned with the teeth 38 associated with the other of the opposed horizontal longitudinal edges of the panels 32, 72 and 78. It is also important to recognize that the pair of panels 32 or 72 and 78 are positioned relative to each other such that the teeth 38 associated with the row of alternating teeth 38 and sockets 40 located adjacent the outer surface 36 of one of the pair of panels 32 forming the block 30, or adjacent the outer surface 76 or 82 of one of the pair of panels 72 or 78 forming the block 70, are horizontally aligned with the sockets 40 associated with the row of alternating teeth and sockets located adjacent the outer surface of the other of the pair of panels forming blocks 30 and 70, and the teeth 38 associated with the row of alternating teeth 38 and sockets 40 located adjacent the inner surface 34 of one of the pair of panels 32 forming the block 30, or adjacent the inner surface 74 or 80 of one of the pair of panels 72 or 78 forming the block 70, are horizontally aligned with the sockets 40 associated with the row of alternating teeth and sockets located adjacent the inner surface of the other of the pair of panels forming blocks 30 and 70. Employing such a tooth 38 and socket 40 configuration along opposing longitudinal edges of a given panel 32, 72 or 78, yields a panel 32, 72 or 78 having opposing longitudinal edges capable of engageably receiving either opposing longitudinal edge of an adjacent, similarly configured, panel 32, 72 or 78 of a straight block 30 or a corner block 70 in stacked fashion. As a result, straight or corner blocks 30 and 70 employing panels 32, 72 and 78 having opposing longitudinal edges of this configuration can be engageably stacked upon and below adjacent blocks 30 and 70 of substantially the same configuration, regardless of the vertical and/or horizontal orientation of the panels 32, 72 and 78 around their respective longitudinal axes. Thus, in the event that it is desirable to cut a planar or corner block 30 and 70 in two pieces/half vertically or horizontally, both resultant pieces/halves of the block 30 and 70 are usable, thereby reducing the waste generated by prior art block designs. This engaging means thereby reduces the overall construction cost and time.

The length of each tooth 38 laterally along the longitudinal axis of a panel 32, 72 or 78 determines the usable incremental portions of a block 30 and 70 when vertically separated. Thus, the smaller the lateral length of the tooth 38 along the longitudinal axis of the panels 32, 72 and 78, the greater the quantity of available usable vertical increments of the blocks 30 and 70. However, the greater the lateral cross-sectional area of a tooth 38, the greater the strength of the tooth 38.

In a preferred embodiment, each tooth 38 is substantially one inch along each side of its lateral cross-sectional perimeter, and projects outwardly from the panels 32, 72 and 78 a distance of substantially one-half of an inch. It has been found that teeth 38 of this dimension yield blocks 30 and 70 that are able to be cut into a sufficient quantity of usable vertical increments, while providing a tooth 38 of sufficient strength to effectively resist breakage. Furthermore, in a preferred embodiment, the resultant socket 40 formed between adjacent teeth 38 is of such dimensions as to enable the socket 42 to snugly and engageably receive a tooth 38 therewithin. Advantageously, a bevel 46 is formed along at least a portion of the perimeter of the distal end of each tooth 38 to serve as a guide to direct the tooth 38 within a corresponding socket 40. In one embodiment, shown in FIG. 5, the bevel 46 is formed along and throughout the perimeter of the distal end. In another embodiment, (not shown), the bevel 46 is formed only along and throughout the three sides of the perimeter of the distal end that are not coplanar with the outer surface 36 of the panel 32.

As with the opposing longitudinal edges of the panels 32, 72 and 78, the opposing vertical ends of the panels 32, 72 and 78 have an array of teeth 42 and sockets 44 formed therein to engageably receive either opposing vertical end of similarly configured panels 32, 72 and 78, thereby yielding blocks 30 and 70 that can engageably receive horizontally adjacent blocks 30 and 70, regardless of the horizontal orientation of their vertical ends. In a preferred embodiment, the array consists of two vertical columns of alternating teeth 42 and sockets 44 offset from each other by the length of one tooth 42. Here again, the location of the teeth 42 associated with one of the vertical longitudinal edges of the panels 32, 72 and 78 correspond with the location of the sockets 44 associated with the other of the vertical longitudinal edges of the panels 32, 72 and 78; and the location of the sockets 44 associated with one of the vertical longitudinal edges of the panels 32, 72 and 74 correspond with the location of the teeth 42 associated with the other of the vertical longitudinal edges of the panels 32, 72 and 78.

The blocks 30 and 70 can be divided into a maximum of two, equal, usable horizontal increments. Consequently, an elongated tooth 42 having a longitudinal length substantially equal to half the vertical height of a block 30 or 70 provides the maximum tooth strength for the maximum quantity of usable horizontal block increments. The elongated tooth 42 extends laterally inwardly from the adjacent surface of the panels 32, 72 and 78 for substantially half the thickness of the panels 32, 72 and 78, while extending uniformly outwardly from the vertical end of the panels 32, 72 and 78 for a distance of substantially half an inch. The elongated socket 44 dimensions resulting from adjacent elongated teeth 42 are such that an elongated tooth 42 can be engageably received therein.

In the event that it is desirable to laterally divide a straight block 30 in half, the exterior surface 36 of each panel 32 includes a mark or indicator 48 along its central longitudinal axis. Likewise, in the event that it is desirable to laterally divide a corner block 70 in half, the exterior surface 76 and 82 of the inner and outer corner panels 72 and 78, respectively, include a mark or indicator 84 along their respective central longitudinal axis. The marks or indicators 48 and 84 aid in accurately severing a block 30 and 70 laterally into equal halves.

Figure 6:
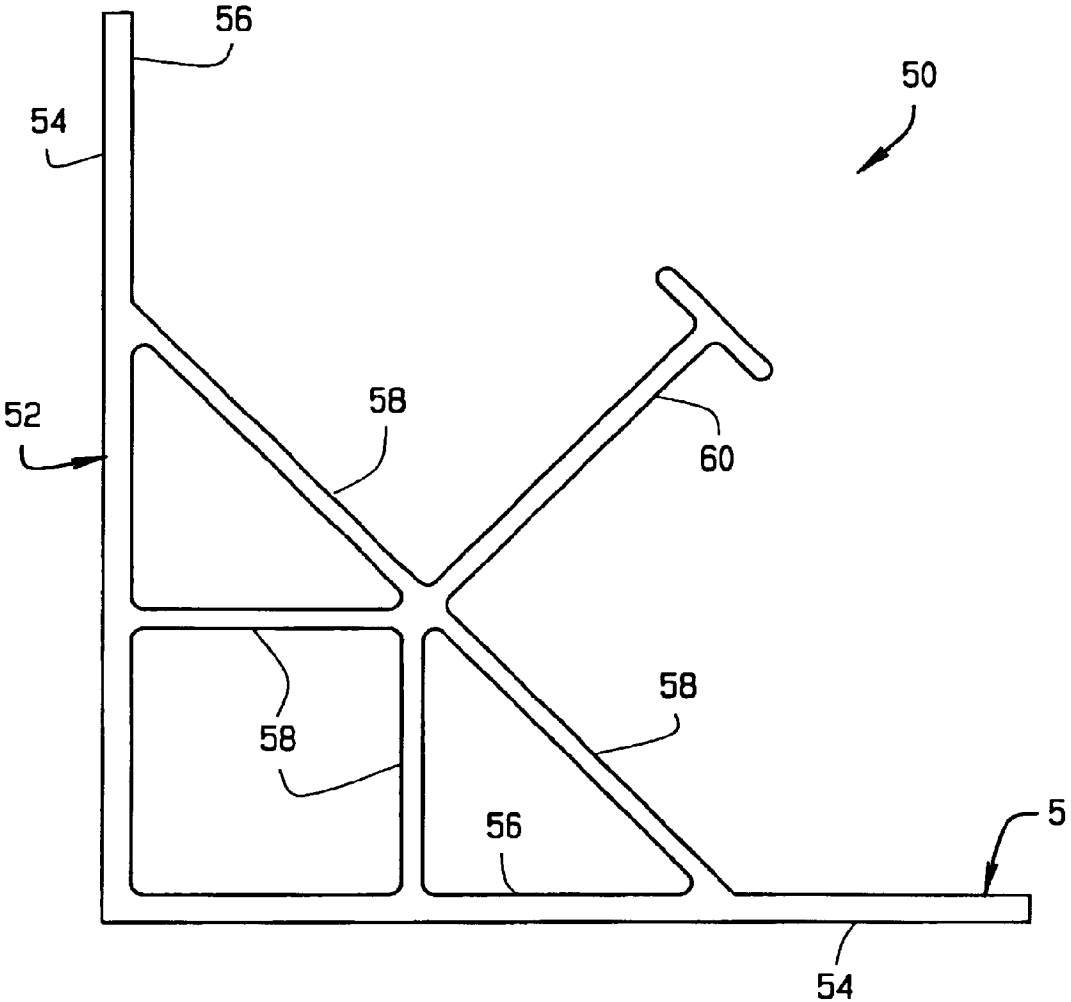
FIG. 6. is an enlarged plan view of the corner tie of the present invention.

A corner tie 50 is shown in FIG. 6 including a pair of flange members 52 sharing a common end and extending perpendicularly from each other, each flange member 52 having an outer surface 54 and an inner surface 56. An array of web members 58 connects the inner surfaces 56 of each flange 52. A concrete-engaging member 60 extends inwardly from the web 58 at substantially a 45° angle from either flange 52.

Figure 7:
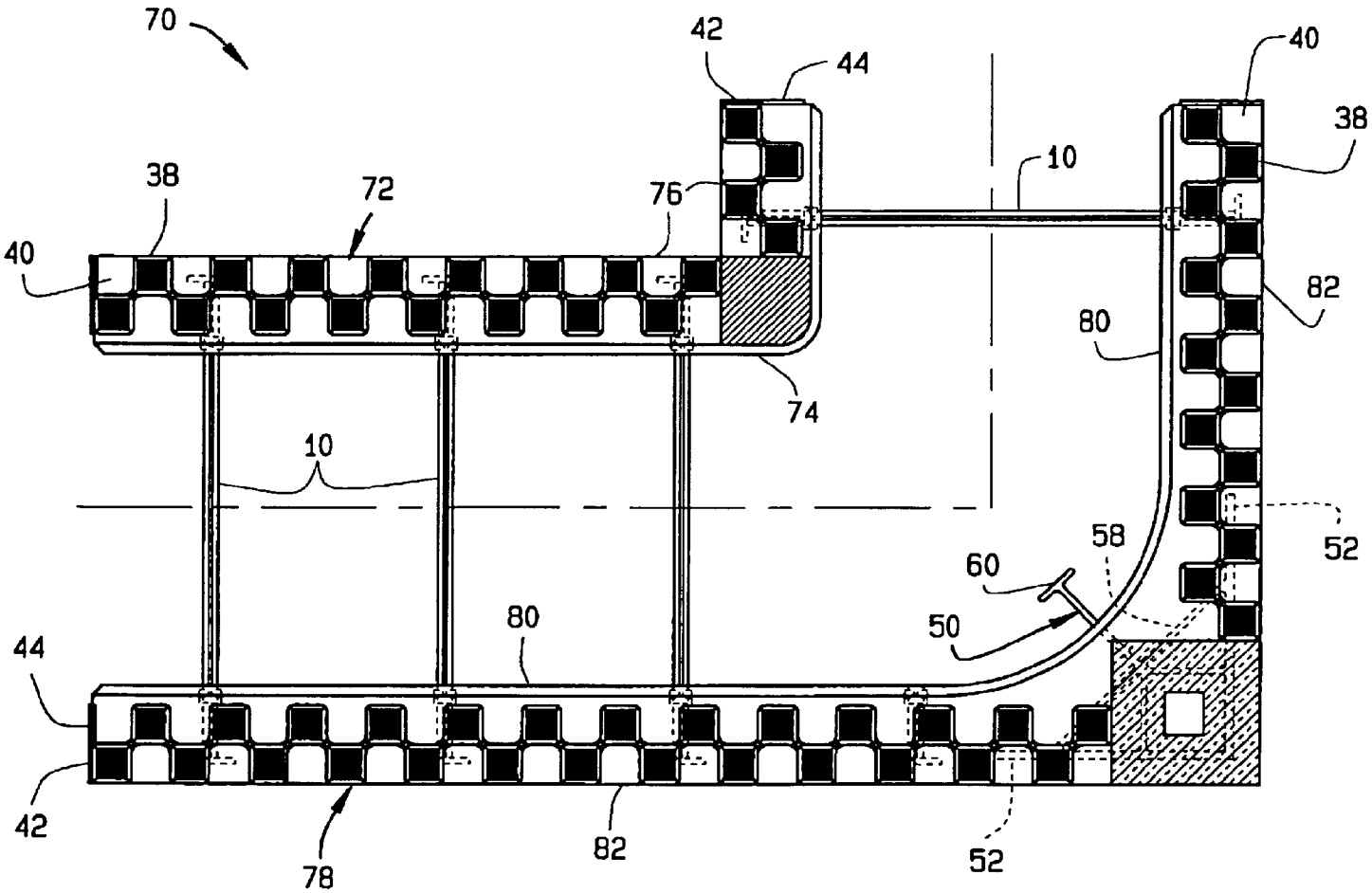
FIG. 7. is a plan view of a corner foam form block of the present invention including the corner tie illustrated in FIG. 6.
Figure 8:
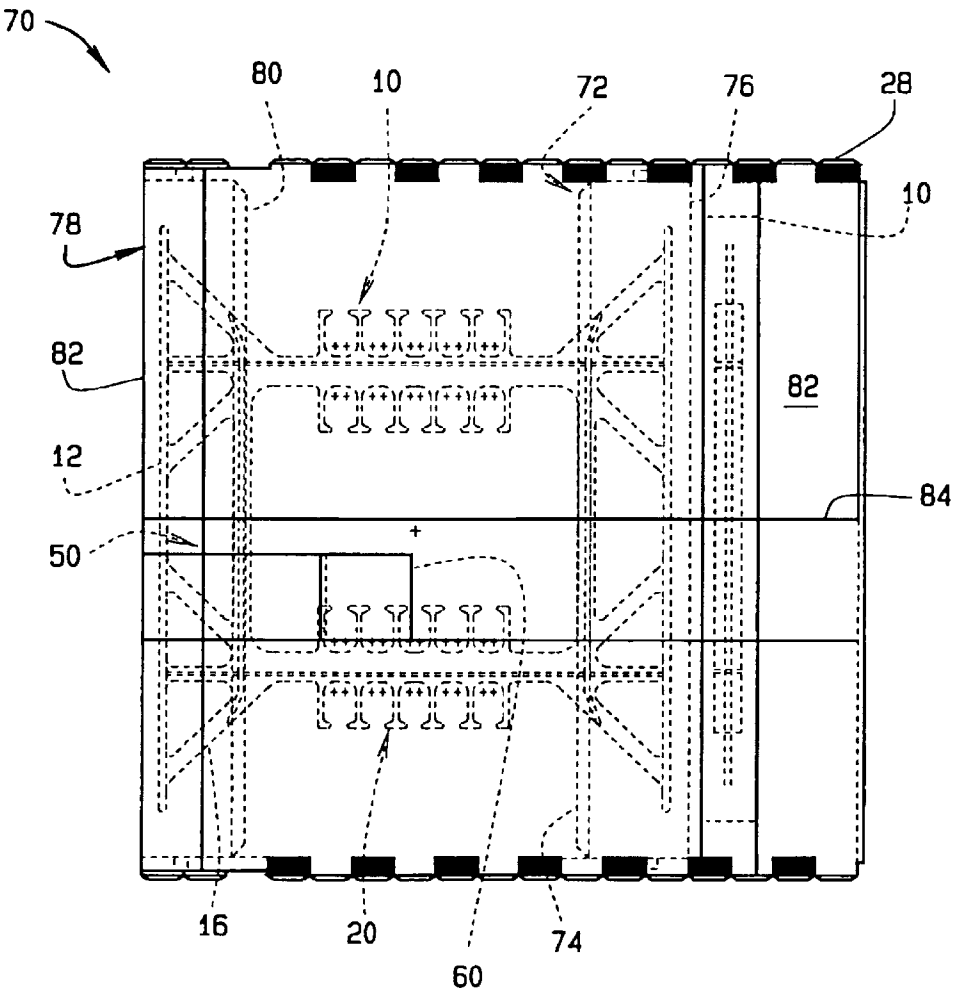
FIG. 8. Is a right end elevational view of the corner block shown in FIG. 7.

A corner block 70 is shown in FIG. 7 including an inner corner panel 72 having an inner surface 74 and an outer surface 76, an outer corner panel 78 having an inner surface 80 and an outer surface 82, and a plurality of ties 10 having opposing flange ends 12, each opposing flange 12 being encapsulated within a respective panel 72 and 78, thereby retaining the inner surfaces 74 and 80 of the corner panels 72 and 78, respectively, in opposing fashion. The corner block 70 includes planar rectangular segments which are disposed at approximately 90° to each other in an angular relationship. As illustrated in FIGS. 7 and 8, the flange members 52 and web members 58 of the corner tie 50 are completely encapsulated within the outer corner panel 78 at its corner, offset vertically from the central horizontal axis of the block 70. The concrete-engaging member 60 extends from the web 58 inwardly beyond the inner surface 80 of the outer block 78, enabling the concrete-engaging member 60 to be completely encapsulated by concrete when it is poured between the corner panels 72 and 78.

In the field, pre-constructed planar or straight blocks 30 and corner blocks 70 are shipped to a construction site that has been prepared in readiness for a concrete wall to be constructed thereon. Due to the tooth 38 and socket 40 design formed along opposing longitudinal edges of the straight blocks 30 and corner blocks 70, the tooth 42 and socket 44 design formed in the opposing vertical ends of the straight blocks 30 and corner blocks 70, and the functionally vertical reversible design of the rebar-retaining seats 20 of the ties 10, the straight blocks 30 and corner blocks 70 are functionally vertically reversible and horizontally reversible. That is to say that the planar blocks 30 and corner blocks 70 can engageably receive a planar block 30 or a corner block 70 there below, thereupon, or adjacent its opposing vertical ends regardless of vertical orientation of its opposing longitudinal edges and regardless of horizontal orientation of its opposing vertical ends. More specifically, the top longitudinal edges of the panels forming blocks 30 and 70 will removably engage both the top and bottom longitudinal edges of the panels forming another similarly constructed block 30 and/or 70, and the bottom longitudinal edges of the panels forming blocks 30 and 70 will removably engage both the top and bottom longitudinal edges of the panels forming another similarly constructed block 30 and/or 70. Furthermore, rebar rods may be retainably placed within rebar seats 20 of a straight block 30 or a corner block 70 regardless of vertical orientation of the longitudinal edges of the blocks 30 and 70 and regardless of whether the blocks 30 and 70 have been laterally cut in half. This versatility of the straight blocks 30 and corner blocks 70 provides an ICFS that can be more rapidly constructed than prior art designs, thereby appreciably reducing labor costs.

Furthermore, due to the open web 14 design of the ties 10, optimal concrete flow is realized. As a result, even a viscous concrete mix can be poured without creating unwanted gaps and voids, thereby minimizing time spent pouring the concrete and enabling a greater variety of usable concrete mixes. Consequently, a wall of optimal concrete strength can be constructed in a reduced amount of time while producing a minimum of product waste and, ultimately, reducing labor costs.

The opposing flanges 12 of each tie 10 run substantially the vertical height of the block 30, thereby providing strength throughout the height of the block 30 sufficient to prevent the opposing panels 32 from being displaced by the outward forces created when concrete is poured there between. In a preferred embodiment, the flanges 12 are 14¾ inches in height, 1½ inches wide and 3/16 of an inch thick, thereby providing a flange 12 that can serve as a stud to which interior and exterior facades can be anchored. The inner surface 34 and outer surface 36 of the block 30, as well as the outer surface 76 and outer surface 82 of the inner corner panel 72 and outer corner panel 78, respectively, are substantially flat surfaces. The panels 32, the inner corner panels 72 and the outer corner panels 78 are approximately 2½ inches thick with the flanges 12 being positioned inwardly from the outer surface of the panels 32, 72 and 78 by ½ inch. To facilitate locating the flanges 12 to serve as anchoring studs, flange indicators 86 are molded into the outer surface of the panels 32, 72 and 78, as shown in FIG. 5.

In one embodiment, shown in FIGS. 1, 3, 4, 7 and 8, the ties 10 are twelve inches wide and the panels 32, 72 and 78 are two and a half inches thick, yielding a block 30 or 70 thirteen inches thick and a concrete wall eight inches thick. In another embodiment, (not shown), the ties 10 are ten inches wide and the panels 32, 72 and 78 are two and a half inches thick, yielding a block 30 or 70 eleven inches thick and a concrete wall six inches thick. In yet another embodiment, (not shown), the ties 10 are seven inches wide and the panels 32, 72 and 78 are two inches thick, yielding a block 30 or 70 eight inches thick and a concrete wall four inches thick. It is understood that any of a variety of tie 10, panel 32, 72 or 78, and block 30 or 70 dimensions may represent a preferred embodiment for a given ICFS application.

In a preferred embodiment, the blocks 30 have panels that are 48 inches long and 16 inches high, and employ 8 ties 10 spaced at 6 inch intervals.

As with the flanges 12 of the ties 10, the flanges 52 of the corner ties 50 serve as anchoring studs for exterior facades fastened to the corner block 70. In a preferred embodiment, the flanges 52 are spaced inwardly from their respective outer surface 82 by a distance of ½ inch. Flange 52 indicator markings (not shown) located in the outer surface 82 of the outer corner panel 72 facilitate locating the flanges 52 for anchoring the facade thereto. Once the poured concrete has cured, the concrete/engaging member 60 prevents the corner tie 50 from being displaced from the corner block 70 due to anchor forces incurred by the facade mounted thereto.

Facade corner covers (not shown) include a pair of planar surfaces joined along a common edge in angular relationship to each other and having apertures for receiving fastening hardware therethrough spaced outwardly from the common edge. When installed, the planar surfaces are spaced outwardly from a respective outer surface 82 of an outer corner panel 78, with the common edge being spaced outwardly from, and aligned with, the outer corner edge of the corner block 70. In a preferred embodiment, the flanges 52 extend laterally from their common end a sufficient distance to enable fastening hardware inserted through the corner cover apertures to be engageably anchored to a respective flange 52 when the facade corner cover is positioned for installation.

As is evident from the foregoing description, certain aspects of the present invention are not limited by the particular details of the examples illustrated herein and it is therefore contemplated that other modifications and applications, or equivalents thereof, will occur to those skills in the art. It is accordingly intended that the claims shall cover all such modifications and applications that do not depart from the spirit and scope of the present invention.

Other aspects, objects and advantages of the present invention can be obtained from a study of the drawings, the disclosure and the appended claims.

What is claimed is:

1. A foam block concrete form having ton and bottom longitudinal edges comprising:

a pair of opposing foam panels spaced parallel from each other, each panel having at least one substantially planar rectangular segment having a horizontal pair of opposing longitudinal edges, a vertical pair of longitudinal edges, and inner and outer surfaces;

engaging means formed along the horizontal and vertical pairs of longitudinal edges associated with each panel for removably engaging one block form with other block forms having similar and complimentary engaging means associated therewith when placed both side-by-side and vertically adjacent thereto;

the engaging means associated with the horizontal pair of opposing longitudinal edges of each panel including two rows of alternating teeth and sockets along each edge, one row being offset from the other row by the distance of one side of one tooth, the teeth associated with one of the opposed horizontal longitudinal edges being vertically aligned with the sockets associated with the other of the opposed horizontal longitudinal edges and the sockets associated with one of the opposed horizontal longitudinal edges being vertically aligned with the teeth associated with the other of the opposed horizontal longitudinal edges;

said pair of opposing panels forming said block form being disposed relative to each other such that the teeth associated with the row of alternating teeth and sockets located adjacent the outer surface of one of said pair of panels are horizontally aligned with the sockets associated with the row of alternating teeth and sockets located adjacent the outer surface of the other of said pair of panels, and the teeth associated with the row of alternating teeth and sockets located adjacent the inner surface of one of said pair of panels are horizontally aligned with the sockets associated with the row of alternating teeth and sockets located adjacent the inner surface of the other of said pair of panels; and a plurality of substantially planar ties positioned transverse to and between the pair of opposing foam panels, each tie including a web portion separating a pair of opposed flange members encapsulated within respective opposing foam panels along a respective lateral panel axis;

said engaging means enabling one of said block forms to be engaged with a plurality of similarly constructed block forms in both a side-by-side arrangement and a vertically stacked arrangement regardless of the orientation of said block forms the top longitudinal edges of one block form being engageable with both the top and bottom longitudinal edges of another similarly constructed block form and the bottom longitudinal edges of one block form being engageable with both the top and bottom longitudinal edges of another similarly constructed block form.

2. The apparatus of claim 1 wherein each opposing foam panel includes two substantially planar rectangular segments in angular relation to each other, each segment having at least one pair of opposing edges.

3. The apparatus of claim 1 wherein each opposing flange member is substantially planar and of sufficient strength to function as an anchoring stud.

4. The apparatus of claim 3 wherein each opposing flange member can be functionally encased within a respective opposing foam panel.

5. The apparatus of claim 4 wherein the opposing foam panels have a longitudinal axis and the opposing flange members have a longitudinal axis substantially equal in length to the transverse axis of the respective foam panel.

6. The apparatus of claim 1 wherein the web portion includes a pair of bridge members formed therein spaced parallel from each other and transverse to the opposing flange members.

7. The apparatus of claim 6 wherein each bridge member includes at least one rebar-retaining seat positioned therealong extending outwardly therefrom.

8. The apparatus of claim 7 wherein each bridge member includes at least one rebar-retaining seat positioned therealong extending inwardly therefrom.

9. The apparatus of claim 8 wherein the rebar-retaining seats are sufficiently large to retainably receive a plurality of rebar rods therewithin.

10. The apparatus of claim 6 wherein the opposing bridge members, in conjunction with each other, provide uniformly distributed structural support about the central lateral axis of the tie.

11. The apparatus of claim 10 wherein the opposing bridge members individually provide uniformly distributed structural support about their respective longitudinal axis when the tie is laterally cut in half.

12. The apparatus of claim 6 wherein each bridge member includes at least one re-bar retaining seat positioned therealong extending outwardly therefrom and at least one re-bar retaining seat positioned therealong extending inwardly therefrom.

13. A foam block concrete form comprising:

a pair of opposing foam panels spaced apart in a substantially parallel relationship, each panel including a pair of horizontally opposed edges and inner and outer surfaces;

a plurality of ties extending between and connecting the foam panels; and two rows of alternating teeth and sockets associated with each horizontally opposed edge of each panel, one row being positioned adjacent the outer surface of said panel and one row being positioned adjacent the inner surface of said panel and one row being offset from the other row such that when said pair of opposed panels are disposed relative to each other to form said block form the teeth associated with the row of alternating teeth and sockets positioned adjacent the outer surface of one of said pair of panels are horizontally aligned with the sockets associated with the row of alternating teeth and sockets positioned adjacent the outer surface of the other of said pair of panels forming said block form, and the teeth associated with the row of alternating teeth and sockets positioned adjacent the inner surface of one of said pair of panels are horizontally aligned with the sockets associated with the row of alternating teeth and sockets positioned adjacent the inner surface of the other of said pair of panels forming said block form;

said two rows of alternating teeth and sockets associated with each horizontally opposed edge of each panel forming said block form and their horizontal positioning relative to each other enabling one of said block forms to be engaged with a plurality of similarly constructed block forms in a vertically stacked arrangement regardless of the orientation of said block forms, the top horizontal edges of one block form being engageable with both the top and bottom horizontal edges of another similarly constructed block form and the bottom horizontal edges of one block form being engageable with the top and bottom horizontal edges of another similarly constructed block form.

14. A concrete block form comprising:

a pair of opposing panels positioned and spaced apart in a substantially parallel relationship to each other, each panel having a pair of horizontally opposed longitudinally edges, a pair of vertical longitudinal edges, and inner and outer surfaces;

engagement means formed along the horizontal and vertical pairs of longitudinal edges associated with each panel for removably attaching one concrete block form to other concrete block forms having similar and complimentary engaging means associated therewith when such concrete block forms are placed both side-by-side and vertically adjacent thereto;

the engaging means associated with the horizontal pair of opposing longitudinal edges associated with each panel including two rows of alternating teeth and sockets along each edge, one row being offset from the other row, the teeth associated with one of the opposed horizontal longitudinal edges being vertically aligned with the sockets associated with the other horizontally opposed longitudinal edge, and the sockets associated with one of the opposed horizontal longitudinal edges being vertically aligned with the teeth associated with the other horizontally opposed longitudinal edge;

the engaging means associated with the vertical pair of longitudinal edges including two columns of alternating teeth and sockets, one column being offset from the other column, the location of the teeth associated with one of the vertical longitudinal edges corresponding with the sockets associated with the other of the vertical longitudinal edges and the location of the sockets associated with one of the vertical longitudinal edges corresponding with the location of the teeth associated with the other of the vertical longitudinal edges;

said pair of panels forming said concrete block form being disposed relative to each other such that the teeth associated with the row of alternating teeth and sockets located adjacent the outer surface of one of said pair of panels are horizontally aligned with the sockets associated with the row of alternating teeth and sockets located adjacent the outer surface of the other of said pair of panels, and the teeth associated with the row of alternating teeth and sockets located adjacent the inner surface of one of said pair of panels being horizontally aligned with the sockets associated with the row of alternating teeth and sockets located adjacent the inner surface of the other of said pair of panels; and a plurality of ties extending between said pair of opposed panels for holding said panels in said spaced apart substantially parallel relationship;

said engaging means enabling one of said concrete block forms to be engaged with a plurality of similarly constructed concrete block forms in both a side-by-side arrangement and a vertically stacked arrangement regardless of the orientation of said concrete block forms, the top longitudinal edges of one concrete block form being engageable with both the top and bottom longitudinal edges of another similarly constructed block form and the bottom longitudinal edges of one concrete block form being engageable with both the top and bottom longitudinal edges of another similarly constructed concrete block form.

15. A foam block concrete form comprising:

a pair of opposing panels positioned and spaced apart in substantially parallel relationship to each other, each panel having top and bottom horizontal longitudinal edges, first and second end portions, and inner and outer surfaces;

a plurality of ties extending between said pair of opposed panels for holding said panels in said spaced apart substantially parallel relationship;

first engaging means associated with the first and second end portions of each panel for removably attaching one pair of panels to a similarly constructed pair of panels in side-by-side relationship to each other; and second engaging means associated with the top and bottom longitudinal edges of each panel for stackably attaching one pair of panels to another similarly constructed pair of panels, said second engaging means including two rows of alternating teeth and sockets along each edge, one row being offset from the other row, the teeth associated with the top longitudinal edge being vertically aligned with the sockets associated with the bottom longitudinal edge;

said pair of panels forming said block form being disposed relative to each other such that the teeth associated with the row of alternating teeth and sockets located adjacent the outer surface of one of said pair of panels are horizontally aligned with the sockets associated with the row of alternating teeth and sockets located adjacent the outer surface of the other of said pair of panels, and the teeth associated with the row of alternating teeth and sockets located adjacent the inner surface of one of said pair of panels being horizontally aligned with the sockets associated with the row of alternating teeth and sockets located adjacent the inner surface of the other of said pair of panels; and said second engaging means enabling one of said block forms to be vertically removably attached with a plurality of similarly constructed block forms regardless of the orientation of said block forms, the top longitudinal edges of one block form being engageable with both the top and bottom longitudinal edges of another similarly constructed block form, and the bottom longitudinal edges of one block form being engageable with both the top and bottom longitudinal edges of another similarly constructed block form.

16. The apparatus of claim 15 wherein each of said plurality of ties includes a web portion positioned between a pair of opposed flange members, each flange member being encapsulated within one of said respective pair of opposing panels.

17. The apparatus of claim 15 wherein said first and second engaging means are substantially identical in construction.

* * * * *

UNITED STATES PATENT AND TRADEMARK OFFICE

CERTIFICATE OF CORRECTION

PATENT NO. : 6,820,384 B1
DATED : November 23, 2004
INVENTOR(S) : Henry Edward Pfeiffer It is certified that error appears in the above-identified patent and that said Letters Patent is hereby corrected as shown below:

Column 8,
Line 51, delete “ton” and replace with -- top --.

Signed and Sealed this

First Day of March, 2005

JON W. DUDAS
*Director of the United States Patent and Trademark Office*